United States Patent [19]

Sugimoto et al.

[11] 4,347,925

[45] Sep. 7, 1982

[54] MALFUNCTION INDICATION DEVICE FOR A VENDING MACHINE

[75] Inventors: Osamu Sugimoto; Masaki Akagawa, both of Sakado, Japan

[73] Assignee: Kabushiki Kaisha Nippon Coinco, Tokyo, Japan

[21] Appl. No.: 196,072

[22] Filed: Oct. 10, 1980

[30] Foreign Application Priority Data

Oct. 16, 1979 [JP] Japan ..... 54-143023

[51] Int. Cl.[3] ..... G07F 9/02

[52] U.S. Cl. ..... 194/1 N

[58] Field of Search ..... 194/1 R, 1 N, 2, 10; 221/21; 364/478, 479; 340/500, 501, 540, 679

[56] References Cited

U.S. PATENT DOCUMENTS 4,233,660 11/1980 Fagan ..... 194/1 N X
4,240,635 12/1980 Brown ..... 194/1 R
4,272,757 6/1981 McLaughlin et al. ..... 194/1 N X

FOREIGN PATENT DOCUMENTS 54-39200 3/1979 Japan ..... 221/21

*Primary Examiner*—Stanley H. Tollberg
*Attorney, Agent, or Firm*—Spensley, Horn, Jubas & Lubitz

[57] ABSTRACT

In the malfunction indication device for a vending machine according to this invention, a malfunction occurrence indicator is provided at a prominent place on the outside of the vending machine. This indicator indicates occurrence of malfunction immediately upon detection of the malfunction by a malfunction detector to give warning to a purchaser. Simultaneously, a code representing a detected malfunctioning point is stored in a memory circuit. By manipulation of an indication control switch by an operator, the code representing the malfunctioning point is read from this memory circuit and indicated by a malfunction code indicator. As the malfunction occurrence indicator and the malfunction code indicator, a money amount indicator already provided in the vending machine for indicating an amount of deposited coins or a balance thereof is advantageously utilized. For enabling the money amount indicator to function as the malfunction occurrence indicator, present contents of indication of the money amount indicator are intermittently indicated by an intermittent driving of the indicator when the malfunction has been detected. For enabling the money amount indicator to function as the malfunction code indicator, the code representing the malfunctioning point is indicated by the money amount indicator only when the indication control switch is manipulated.

6 Claims, 4 Drawing Figures

MALFUNCTION INDICATION DEVICE FOR A VENDING MACHINE

SUMMARY OF THE INVENTION

This invention relates to a malfunction indication device for a vending machine.

There has been known a vending machine equipped with a function to detect malfunctions. This known type of vending machine, however, is only capable of shutting off a coin slot in case it has found malfunction and, accordingly, it is insufficient in conveying information of occurrence of malfunction to customers. The customers who are not informed of malfunctioning of the vending machine try to throw a coin into a coin slot and it is not before he faces a situation in which he cannot deposit a coin on account of shutting off of the coin slot or in which the deposited coin is immediately returned to a coin return outlet that he finds malfunctioning of the vending machine. Such insufficiency in the information adversely affects the customer's inclination for utilizing a vending machine and hence is undesirable from the standpoint of service to the customers.

It is, therefore, an object of the present invention to provide a malfunction indication device for a vending machine designed for improving service to the customers. This object of the invention is achieved by providing malfunction occurrence indication means at a prominent place on the outside of the vending machine and effecting an indication of occurrence of malfunction immediately upon detection of such malfunction whereby the customer who stands in front of the vending machine becomes instantly aware of the fact that the vending machine is out of order. As far as the service to the customers is concerned, it will suffice to indicate that the vending machine is malfunctioning. This, however, is not sufficient for an operator of the vending machine who needs to known a specific point at which the malfunction has occurred in the vending machine. For this reason, in the present invention, a code indicating a malfunctioning point in the vending machine detected by malfunction detection means is stored in a memory circuit and this code stored in the memory circuit is read out by manipulation of an indication control switch by the operator and the read out code is indicated by means of malfunction code indication means. The operator therefore can find a specific point at which the malfunction has occurred by manipulating the indication control switch and reading the code indicated in the malfunction code indication means. In the above described manner, the malfunction indication device according to the present invention is capable of providing perfect information about the malfunction of the vending machine to both the customer and the operator.

In a preferred embodiment of the invention, a conventional money amount indicator which is already provided in a vending machine for indicating a sum (or balance) of deposited coins is utilized in such a manner that occurrence of malfunction is indicated by intermittent indication of a present value of the money amount indicator (or 0 if there is no indication of money amount). A purchaser who has noticed such intermediate indication of the money amount indicator will immediately find that the vending machine is defective without attempting to throw a coin into the coin slot. The utilization of the money amount indicator for indication of occurrence of malfunction is advantageous in respect of the cost of manufacture, for no special lamp needs to be provided for indicating occurrence of malfunction. Moreover, if malfunction occurs in the course of depositing coins one by one, the indicator starts the intermittent indication of an amount of coins which have been deposited until then and, accordingly, an accurate amount of deposited coins at the time of occurrence of malfunction can be readily found and the operator of the vending machine can return the accurate amount of deposited coins to the purchaser whereby trouble between the operator and the purchaser can be avoided. Further, in the preferred embodiment of the invention, the money amount indicator is utilized also as the malfunction code indicating means.

DESCRIPTION OF A PREFERRED EMBODIMENT

Figure 1:
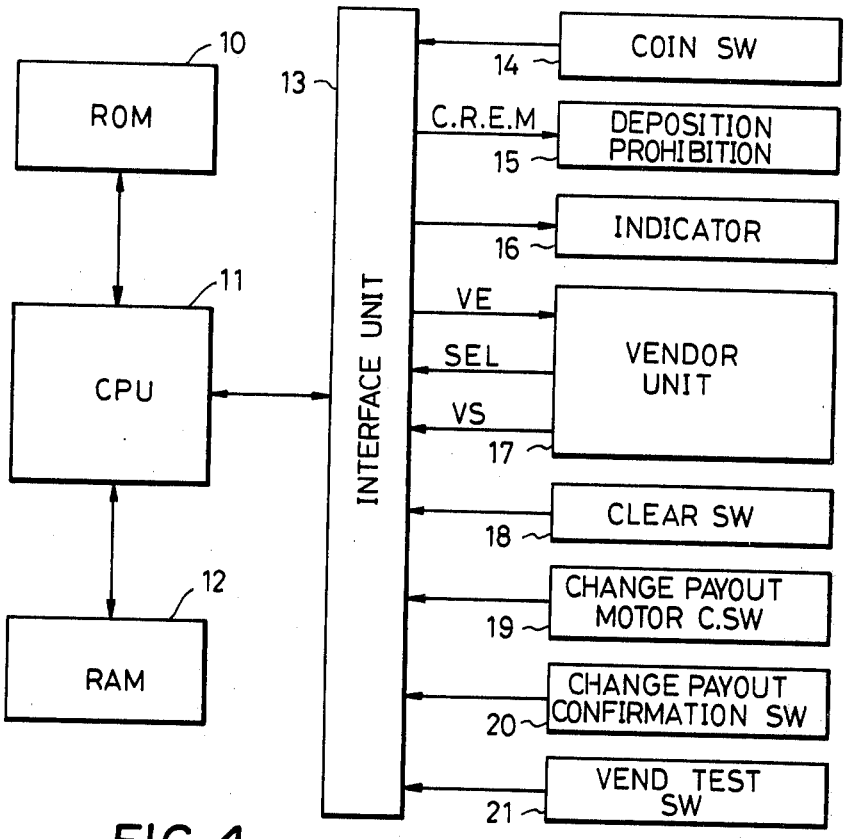
FIG. 1 is a block diagram showing schematically an example of a control device of a vending machine to which the present invention is applicable, which control device being composed of a microcomputer.

FIG. 1 is a schematic block diagram showing a control device of a vending machine composed of a microcomputer. A read-only memory (hereinafter referred to as ROM) 10 stores all preset control programs of the vending machine including a vend operation control and a malfunction detection process. A central process unit (hereinafter referred to as CPU) 11 controls all operations of the vending machine in accordance with the programs stored in the ROM 10. A random access memory (hereinafter referred to as RAM) 12 is a memory capable of both writing and reading and stores results of counting of an amount of money and other information under the control of the CPU 11. An input-output interface unit 13 connects various units of the vending machine with the CPU 11 and transmits signals between them. A coin switch 14 detects a deposited coin (or bill) and produces a coin deposition signal corresponding to the denomination of the deposited coin. A coin deposition prohibition solenoid 15 interrupts a coin slot in response to a coin deposition prohibition signal C.R.E.M. An indicator 16 indicates an amount of deposited coins or balance thereof in accordance with results of counting of the amount of money and is provided at a prominent place on the vending machine. According to the embodiment of the invention, the information of malfunction to the purchaser and the indication of the malfunctioning point to the operator are effected by utilizing this indicator 16. A vendor unit 17 is a device which dispenses an article selected by the purchaser. The vendor unit 17 receives a vend possible signal VE and outputs signals including an article selection signal SEL representing a selected article and a vend start signal VS representing that the article dispensing operation is being performed. A clear switch 18 is switch manipulated by the purchaser when the purchasing is to be suspended or finished for setting the account and receiving change, if any. A change payout motor carrier switch 19 produces a signal representing an ON or OFF state of a carrier switch of a change payout motor. A change payout confirmation switch 20 is a switch for confirming that a change coin or a coin to be returned has been paid out to a coin return outlet and produces a payout confirmation signal in response to the paid out coin. A vend test switch 21 is a switch to be manipulated by the operator for testing the vending operation of the vending machine (mainly the operation of the vendor unit 17). The vend possible signal VE is produced by manipulation of the switch 21 and the operation of the vendor unit 17 thereby is tested. In this embodiment, the vend test switch 21 serves to function as a malfunction code indication command switch.

Figures 2, 3:
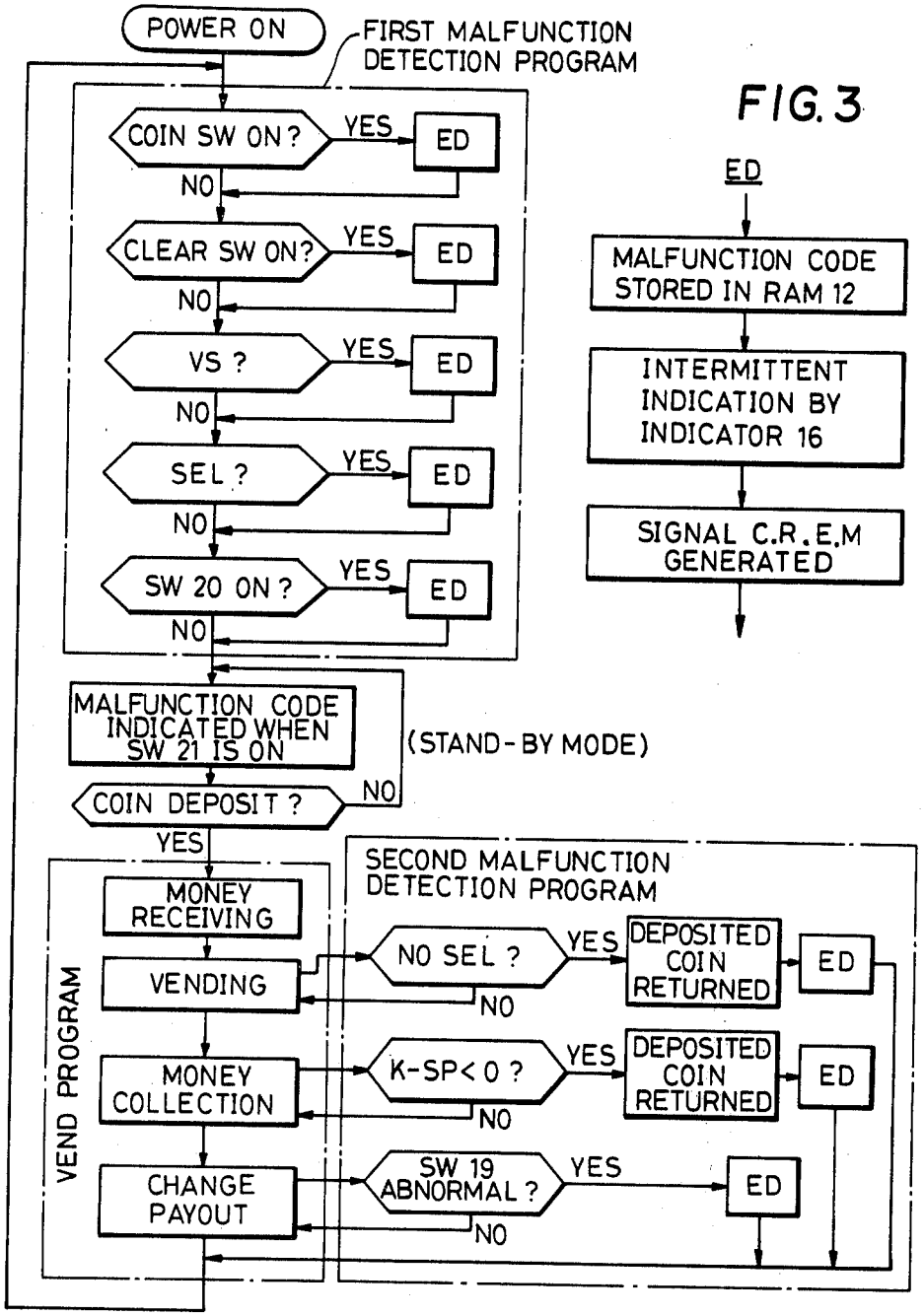
FIG. 2 is a flow chart showing an outline of an example of a control program implemented in the control device of FIG. 1 to which the present invention is applied.
FIG. 3 is a flow chart showing an example of a process in malfunction indication process ED of FIG. 2.

FIG. 2 is a flow chart showing an outline of an example of a control program which is stored in the ROM 10 and implemented by the CPU 11. After turning on of the power source, a first malfunction detection program is carried out and, if no malfunction is detected (i.e., NO), the vending machine enters a stand-by mode. If deposition of a coin is confirmed (i.e., "coin deposition" is YES) in the stand-by mode, the vending machine shifts to a vend program. In the vend program, known processing of "money receiving", "vending", "money collection" and "change payout" are carried out in sequence. More specifically, in the "money receiving" and "vending" processing, the amount of deposited coins is calculated, vend possible signals VE corresponding to articles which are vendible within the amount of the collected coins are produced, the article selection signal SEL is produced upon selection of an article by the purchaser and the vend start signal VS is produced when the article dispensing operation is being performed in the vendor unit 17. In the "money collection" processing, the price of the vended article is subtracted from the amount of the deposited coins. In the "change payout" processing, balance left as a result of the "money collection" processing is paid out as change. In the course of the vend program, detection of whether the necessary component parts in the vending machine are working normally is made by a second malfunction detection program. If no malfunction is detected by the second malfunction detection program, the main vend program is safely completed and the malfunction detection is restored to the first malfunction detection program. If malfunction is detected by the second malfunction detection program, the deposited coin or coins are returned to the purchaser, if such returning is possible, and a malfunction indication processing ED is effected.

Items to be detected in the first and second malfunction detection programs may be selected as desired. Examples of such items are shown hereinbelow. Items to be detected in the first malfunction detection program are as follows:

(1) Is the coin deposition signal being continuously produced by the coin switch 14 (i.e. a judgement of "COIN SW ON?" in FIG. 2)?

(2) Is the clear command signal being continuously produced by the clear signal 18 (i.e. a judgement of "CLEAR SW ON?" in FIG. 2)?

(3) Is the vend start signal VS being continuously produced by the vendor unit 17 (i.e. a judgement of "VS?" in FIG. 2)?

(4) Is the article selection signal SEL being continuously produced by the vendor unit 17 (i.e. a judgement of "SEL?" in FIG. 2)?

(5) Is the payout confirmation signal being continuously produced by the change payout confirmation switch 20 (i.e. a judgement of "SW 20 ON?" in FIG. 2)?

If any of the above signals is being continuously produced while no vending operation is made in the vending machine (i.e., if the answer is YES), this signifies that malfunction has occurred in the switch or in the signal transmission channel where the signal is produced and the malfunction indication processing ED is effected.

Items to be detected in the second malfunction detection program are as follows:

(6) Notwithstanding that the money receiving processing has been made upon deposition of coins and the vend possible signal VE has been generated, the article selection signal SEL is not produced after lapse of a predetermined period of time (i.e. a judgement of "NO SEL?" in FIG. 2). If the article selection signal SEL is not given, which article has been selected is not known and the money collection processing for subtracting the vend price from the amount of the deposited coins cannot be made, so that this case is judged to be a malfunction.

(7) The difference of subtracting the vend price (designated by SP) from the amount (or balance) of the deposited coins (designated by K) is below zero (a negative value) (i.e., a judgement of "K-SP<0?" in FIG. 2). If the answer to the question "K-SP<0" is YES, this signifies that vending is being made in spite of the state in which vending is not possible, so that this state is judged to be a malfunction.

(8) The carrier switch 19 of the change payout motor is not turned on or remains in an ON state for an unduly long time during the change payout processing (i.e. a judgement of "SW 19 ABNORMAL?" in FIG. 2). If the operation of the carrier switch 19 is abnormal, a normal payout of change cannot be expected, so that this state is judged to be a malfunction.

If results of judgement as to the above described items (6), (7) and (8) are all NO, this signifies that the vending machine is operating normally and therefore the vend program is continued. If the result of judgement as to the item (6) or (7) is YES, the deposited coin or coins are returned if possible and the malfunction indication processing ED is effected. If the result of judgement as to the item (8) is YES, the malfunction indication processing ED is effected.

The outline of the malfunction indication processing ED is shown in FIG. 3. First, a code indicating a place where the malfunction has occurred is temporarily stored in the RAM 12. The indicator 16 is intermittently turned on and off to inform the purchaser or the operator of occurrence of malfunction. Simultaneously, the coin deposition prohibition signal C.R.E.M. is produced and the coin deposition prohibition solenoid 15 is actuated in response to the signal C.R.E.M. to shut off the coin slot. The indicator 16 intermittently indicates the result of counting of the amount of the money available at that time. If, accordingly, malfunction is detected by the first malfunction detection program, "0" is intermittently indicated by the indicator 16, whereas if malfunction is detected by the second malfunction detection program, the result of counting of the amount of money available at that time (0 or any value) is intermittently indicated.

In the stand-by mode, whether the vend test switch 21 is ON or OFF is checked. If the vend start switch 21 is OFF, the judgement of "COIN DEPOSITION?" is immediately made. If the vend start switch 21 is ON, the code indicating the point at which malfunction has occurred stored in the RAM 12 is read out and indicated by the indicator 16. The vend test switch 21 acts as a break-in signal to the entire program in that the vend possible signal VE is always generated irrespective of the program to enable testing of the vendor unit 17 when the vend test switch is ON.

In case of a malfunction, therefore, the purchaser can recognize it by the intermittent turning on and off of the indicator 16 when he just stands in front of the vending machine without attempting to deposit a coin into the coin slot. The operator of the vending machine can recognize occurrence of malfunction by the intermittent indication of the indicator 16 and further detect a specific place where the malfunction has occurred by turning on the vend test switch 21 and observing the indication on the indicator 16.

Figure 4:
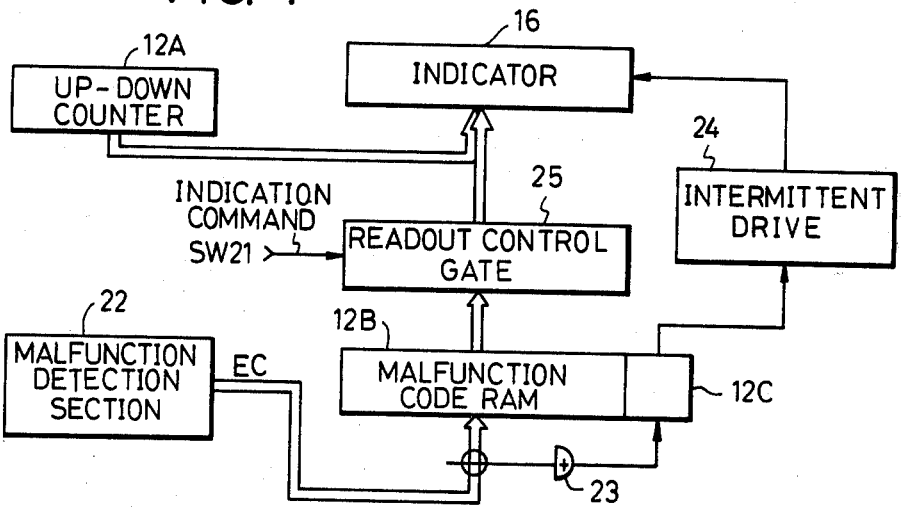
FIG. 4 is a block diagram showing an essential portion of an embodiment of the invention composed of a fixed circuit.

An essential portion of the device according to the invention extracted in the form of a fixed circuit is shown in FIG. 4. An up-down counter 12A adds amounts of deposited coins together and subtracts the vend price and an amount to be paid out for change from the sum of the deposited coins, contents of counting of the counter 12A being indicated by the indicator 16. A malfunction detection section 22 detects malfunctions listed in the items (1)–(8) and thereupon produces a code EC indicating the point at which malfunction has occurred. A malfunction code RAM 12B stores the code EC. A malfunction flag memory 12C is a 1-bit memory storing the fact that the malfunction has been detected. The output of an OR gate 23 which receives all bits of the malfunction code EC is loaded in the memory 12C. When a malfunction has been detected, the code EC indicating the point at which the malfunction has occurred is produced by the section 22 and this code EC is stored in the RAM 12B and simultaneously a signal "1" is stored in the memory 12C. Upon storing of the signal "1" in the memory 12C, an intermittent drive circuit 24 is actuated to intermittently turn on and off the indicator 16. If at this time the contents of counting in the counter 12A are 0, 0 is intermittently indicated by the indicator 16, whereas if the contents of the counter 12A are another value, this value is intermittently indicated.

In the malfunction code RAM 12B, all codes indicating malfunctioning points are stored. Upon turning on of the vend test switch 21, a readout control gate 25 is opened and the malfunction codes stored in the malfunction code RAM 12B are sequentially read out. The read out malfunction codes are supplied to the indicator 16 where the codes indicating the malfunctioning points are sequentially indicated. The readout control gate 25 may be of such a construction that respective addresses of the malfunction code RAM 12B are sequentially accessed by a single turning on of the switch 21 or that each address of the RAM 12B is accessed each time the switch 21 is turned on. The intermittent drive circuit 24 should preferably be disabled upon turning on of the switch 21 so that the intermittent indication is stopped and the malfunction code is continuously indicated. The indicator 16, however, may be intermittently turned on and off even during indication of the malfunction codes. Since contents of the up-down counter 12A are usually "0" when the malfunction code is indicated by the indicator 16, an arrangement may be made so that the output of the counter 12A and the output of the readout control gate 25 are applied to the indicator 16 through an OR gate. For the sake of safety, however, the output of the readout control gate 25 may be applied to the indicator 16 in preference to the output of the counter 12A.

The malfunction code RAM 12B may be so constructed that it stores all individual malfunction codes separately. For saving memory capacity of the RAM 12B, however, the RAM 12B is constructed in such a manner that these malfunction codes are stored by groups. If, for example, the indicator consists of four digits, each code is constituted in such a manner that the most significant digit is used for indicating a group by a letter in alphabet and the other three digits are used for indicating a number in decimal notation. Since letters in alphabet which can be expressed by a 7 element type indication system are H, E, F, P, L etc., these letters are assigned to the most significant digit of respective groups. The numbers expressed by the other three digits within the same group are added together to constitute a code and this code is stored in a memory position corresponding to one address of the RAM 12B. By this arrangement, the RAM 12B may only have addresses of the same number as the number of groups and the memory capacity of the RAM 12B is saved to a large extent. Assume, for example, that letter "H" is assigned to the most significant digit of a certain group and codes corresponding to a malfunctioning points in the group are assigned as shown in Table 1. For the sake of convenience, Table 1 shows contents of decimal number of four digits indicated by the indicator 16 and not binary code signals of letters B, C, D. etc.

TABLE 1

| malfunction code (in decimal notation) | malfunctioning points |
|---|---|
| H 1 0 0 | 100-yen coin switch |
| H 0 1 0 | 50-yen coin switch |
| H 0 0 1 | 10-yen coin switch |

If malfunction has occurred in only one coin switch in the H group, the code corresponding to this switch is directly stored in the address for the H group. If malfunction has occurred in the 100-yen and 50-yen coin switches, a code composed of a sum of the decimal numbers of the three digits of the codes for these coin switches, i.e., H 110, is stored in the address for the H group in the RAM 12B. It should be noted that malfunctioning points to be classified in the same group are not necessarily the same kind of malfunctioning points.

Another example of constitution of malfunction codes is shown in Table 2.

TABLE 2

| malfunction code (in decimal notation) | malfunctioning points |
|---|---|
| E 0 1 0 | carrier switch |
| E 0 2 0 | |
| . | . |
| . | . |
| . | . |
| F 0 1 0 | article selection signal $SEL_1$ |
| F 0 2 0 | 10-yen coin switch |
| F 0 4 0 | vend price signal VS |
| F 1 0 0 | article selection signal $SEL_2$ |

TABLE 2-continued

| malfunction code (in decimal notation) | malfunctioning points |
|---|---|
| F 2 0 0 | 50-yen coin switch |
| F 4 0 0 | article selection signal $SEL_3$ |
| H 0 1 0 | article selection signal $SEL_4$ |
| . | . |
| . | . |
| . | . |
| . | . |
| L 0 1 0 | |
| . | . |
| . | . |
| . | . |
| . | . |

In Table 2, the article selection signals $SEL_1$ through $SEL_4$ represent article selection signals corresponding to respective articles. If, for example, the article selection signal $SEL_1$ corresponding to a certain article is erroneously produced, the malfunction code "F 0 1 0" is generated. As described pereviously, malfunction codes of the same group are added together and stored in the RAM 12B. Accordingly, if malfunctioning of the article selection signal $SEL_1$ and the 10-yen coin switch, for example, has been detected, the malfunction codes "F 0 1 0" and "F 0 2 0" are produced and code "F 0 3 0" which is a sum of the codes "F 0 1 0" and "F 0 2 0" is stored in the address for the group F in the RAM 12B. Consequently, the malfunction code "F 0 3 0" is indicated by the indicator 16. If all of the elements in the group F are malfunctioning, a code "F 770" which is a sum of addition of all of the malfunction codes "F 0 1 0" to "F 400" in the F group is stored in the address for the group F in the RAM 12B and this code "F 770" is indicated.

If, for example, there are 4 groups of E, F, H and L, the RAM 12B needs to have only 4 addresses. If each group includes, for example, 6 kinds of malfunction codes as in the case of the group F in Table 2, 24 kinds of malfunction codes at the maximum can be stored in only 4 addresses. If decimal number of three digits used for the malfunction codes are limited to certain numbers as shown in Table 2 (i.e. 010, 020, . . . 400), it is easy to read the original malfunction codes from a number which is a sum of these original codes. Assume, for example, that "F 0 3 0" is indicated by the indicator 16. In this case, the operator can readily read the two malfunction codes of "F 0 1 0" and "F 0 2 0".

In the case where the 4 groups (E, F, H, L) of malfunction codes are stored in the malfunction code RAM 12B (in the form of a sum of the malfunction codes for each group), an arrangement should preferably be made so that the malfunction codes of the respective groups (each code representing the sum of the malfunction codes) are sequentially read from the readout control gate 25 each time the vend test switch 21 is depressed. For example, the malfunction codes of the group E are read out and indicated by a first depression of the vend test switch 21, those of the group F by a second depression, those of the group H by a third depression and those of the group L by a fourth depression, respectively. Finally, the gate 25 is closed by a fifth depression of the switch 21 and the indication of the malfunction codes thereby is cancelled.

The indication of malfunction is not limited to the intermittent turning on and off of the indicator but it may be made by using a specific letter (e.g. "E"). For unspecified purchaser, however, the intermittent indication seems to be an easier way for informing them of occurrence of malfunction than the indication by a letter. A switch for commanding indication of a code representing a malfunctioning point is not limited to the vend test switch 21 but a switch used exclusively for this purpose may be separately provided. Since the vend test switch 21 acts only to the vendor unit 17 and is irrelevant to the indicator 16, no particular inconvenience takes place by utilizing the vend test switch 21 concurrently for commanding indication of the malfunction codes. Accordingly, it is most advantageous in respect of costs to use the vend test switch 21 concurrently for this purpose.

Malfunctions to be detected by the first and second malfunction detection programs (FIG. 2) or the malfunction detection section 22 (FIG. 4) are not limited to the above described items (1)–(8). If, for example, an electronic coin detector comprising a primary coil and a secondary coil is used as a coin detector, it is beneficial to detect malfunction of an amplifier for amplifying the level of a coin detection signal obtained from the secondary coil. Since a count of a counter circuit for deposited coins is counted up by the output of this amplifier, an accurate counting of the amount of deposited coins cannot be made if the amplifier is malfunctioning and an unexpected loss to the purchaser will result. For detecting malfunction in the amplifier, an amplifier which is of the same function as the amplifier for amplifying the coin detection signal (i.e. output of the secondary coil) may be provided in parallel so that occurrence of malfunction is detected when outputs of these two amplifiers are not in conformity with each other. In a case where the same coin detection signal (output of the secondary coil) is amplified by two amplifiers of the same function, the outputs of the two amplifiers should conform to each other if the amplifiers are operating normally. Accordingly, if there is discrepancy between the outputs of the two amplifiers, one of the amplifiers may be judged to be malfunctioning.

What we claim is:

1. A malfunction indication device for a vending machine including means for detecting malfunction in the vending machine characterized by comprising;

malfunction occurrence indication means provided at a prominent place on the outside of the vending machine for indicating occurrence of malfunction if the malfunction has been detected;

memory means for storing codes each representing a malfunctioning point;

an indication control switch; and malfunction code indication means for indicating the codes stored in said memory means in response to operation of said indication control switch.

2. A malfunction indication device for a vending machine as defined in claim 1 wherein said malfunction occurrence indication means provides indication of occurrence of malfunction by intermittent turning on and off.

3. A malfunction indication device for a vending machine as defined in claim 1 wherein said malfunction occurrence indication means comprises a money amount indicator already provided in the vending machine for indicating the amount of deposited coins or a balance thereof and intermittent drive means for driving the money amount indicator to intermittently indicate present contents of the money amount indicator when the malfunction has been detected.

4. A malfunction indication device as defined in claim 1 wherein said malfunction code indication means comprises a money amount indicator already provided in the vending machine for indicating the amount of deposited coins or a balance thereof and control means for reading out the codes stored in said memory means in response to the operation of said indication control switch to have the codes indicated by said money amount indicator.

5. A malfunction indication device for a vending machine as defined in claim 4 wherein each of said codes representing the malfunctioning points consists of a character representing a group to which the malfunctioning point belongs and a decimal number of a plurality of digits which discriminates malfunctioning points in said group;

said memory means stores a sum of addition of the decimal number portions of the codes in the same group together with the character representing said group at one address, and said control means sequentially reads out the character and the sum of the decimal number portions group by group in response to the operation of said indication control switch to have the character and the sum of the decimal number portions indicated by said money amount indicator.

6. A malfunction indication device for a vending machine as defined in claim 5 wherein said indication control switch is a vend test switch already provided in the vending machine.

* * * * *